US010858804B2

(12) United States Patent
Takeuchi et al.

(10) Patent No.: US 10,858,804 B2
(45) Date of Patent: Dec. 8, 2020

(54) WORK MACHINE

(71) Applicant: HITACHI CONSTRUCTION MACHINERY CO. LTD., Tokyo (JP)

(72) Inventors: Hiroki Takeuchi, Tsukuba (JP); Kouji Ishikawa, Kasumigaura (JP); Shiho Izumi, Hitachinaka (JP); Shuuichi Meguriya, Ishioka (JP); Tarou Akita, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 169 days.

(21) Appl. No.: 15/998,946

(22) PCT Filed: Mar. 2, 2017

(86) PCT No.: PCT/JP2017/008369
§ 371 (c)(1),
(2) Date: Aug. 17, 2018

(87) PCT Pub. No.: WO2017/212709
PCT Pub. Date: Dec. 14, 2017

(65) Prior Publication Data

US 2020/0095748 A1 Mar. 26, 2020

(30) Foreign Application Priority Data

Jun. 9, 2016 (JP) ..... 2016-115123

(51) Int. Cl.
*E02F 9/20* (2006.01)
*E02F 3/43* (2006.01)
(Continued)

(52) U.S. Cl.
CPC ..... *E02F 9/2029* (2013.01); *E02F 3/435* (2013.01); *E02F 9/2004* (2013.01);
(Continued)

(58) Field of Classification Search
CPC ..... E02F 9/2029; F15B 11/04
See application file for complete search history.

(56) References Cited

U.S. PATENT DOCUMENTS 5,640,892 A 6/1997 Kauss et al.
5,735,065 A 4/1998 Yamagata et al.

FOREIGN PATENT DOCUMENTS

JP 07-071051 A 3/1995
JP 08-500418 A 1/1996
(Continued)

OTHER PUBLICATIONS

International Search Report of PCT/JP2017/008369 dated Jun. 6, 2017.

(Continued)

*Primary Examiner* — Anne Marie Antonucci
*Assistant Examiner* — Abdalla A Khaled
(74) *Attorney, Agent, or Firm* — Mattingly & Malur, PC

(57) ABSTRACT

A work machine including a front control section configured to calculate a limit command value for restricting an operation of a front work implement includes: for example, a bypass line that bypasses, for example, the proportional solenoid valve in, for example, the pilot line; for example, a bypass valve disposed in, for example, the bypass line; a switch configured to output a signal to turn on or off control by the front control section; an on/off determining part configured to determine whether the signal from the switch is an on signal that brings front control into an on state or an off signal that brings the front control into an off state; an open/close command part configured to generate an open/close command signal to open the bypass valve when the signal is determined to be the off/off signal.

4 Claims, 6 Drawing Sheets

(51) Int. Cl.

| | |
|---|---|
| ***E02F 9/22*** | (2006.01) |
| ***E02F 9/26*** | (2006.01) |
| ***F15B 11/04*** | (2006.01) |

(52) U.S. Cl.

CPC ..... *E02F 9/2235* (2013.01); *E02F 9/2267* (2013.01); *E02F 9/2285* (2013.01); *E02F 9/265* (2013.01); *F15B 11/04* (2013.01); *F15B 2215/30* (2013.01)

(56) References Cited

FOREIGN PATENT DOCUMENTS

| | | | |
|---|---|---|---|
| JP | 3091667 | B | 9/2000 |
| JP | 2010-190368 | A | 9/2010 |
| JP | 2016-003442 | A | 1/2016 |
| WO | 1994/04829 | A | 3/1994 |

OTHER PUBLICATIONS

International Preliminary Report on Patentability received in corresponding International Application No. PCT/JP2017/008369 dated Dec. 20, 2018.

WORK MACHINE

TECHNICAL FIELD

The present invention relates to a work machine including a front control section that performs, for example, area limiting excavation control.

BACKGROUND ART

In a work machine such as a hydraulic excavator, a combined operation of a plurality of operation lever devices is typically performed to operate a front work implement. Manipulating the operation lever devices to operate the front work implement within a predetermined area with care not to excavate below a target excavation surface is a difficult task to perform for a novice operator.

Recent years have witnessed a widespread increase in areas to which work machines that perform front control for limiting operations of the front work implement on the basis of, for example, a bucket position are applied. When the front control is activated, operations of the front work implement are limited so as not to excavate below the target excavation surface. As related art, Japanese Patent No. 3091667 discloses a technique that incorporates a proportional solenoid valve disposed in a pilot line of an operation lever device, so that the proportional solenoid valve reduces pressure of a hydraulic signal output from the operation lever device such that a speed of a front work implement does not exceed a limit value.

PRIOR ART DOCUMENT

Patent Document

Patent Document 1: Japanese Patent No. 3091667

SUMMARY OF THE INVENTION

Problem to be Solved by the Invention

In a hydraulic excavator, for example, responsiveness is required to lever operations during what is called shaking work in which the bucket is shaken and oscillated to even out contents of the bucket, such as sand. Even in what is called slope taming work as slope face forming, responsiveness may at times be required to achieve efficiency in work involving raising and lowering a boom briskly. With the technique disclosed in Japanese Patent No. 3091667, however, because of the proportional solenoid valve disposed in the pilot line, responsiveness of an actuator to lever operations may unfortunately be degraded due to pressure loss of the proportional solenoid valve.

An object of the present invention is to provide a work machine that can achieve both responsiveness of an actuator to an operation and front control functionality.

Means for Solving the Problem

To achieve the foregoing object, an aspect of the present invention provides a work machine that includes a machine body, a front work implement disposed in the machine body, a plurality of hydraulic actuators configured to drive the front work implement, a posture sensor configured to detect posture of the front work implement, a hydraulic pump, a pilot pump, a plurality of control valves configured to control a flow of hydraulic working fluid to be supplied from the hydraulic pump to the hydraulic actuators associated with the respective control valves, operation lever devices configured to generate hydraulic signals directing operations of the hydraulic actuators associated with the respective operation lever devices in response to a control operation, a plurality of pilot lines configured to connect the operation lever devices with hydraulic drive parts of the control valves associated with the respective operation lever devices, a proportional solenoid valve disposed in at least one of the pilot lines, and a front control section configured to calculate a limit command value for restricting operations of the front work implement through control of the proportional solenoid valve using a detection signal of the posture sensor. The work machine includes: a bypass line configured to connect a portion in the pilot line upstream of the proportional solenoid valve and a portion in the pilot line downstream of the proportional solenoid valve; a bypass valve serving as an open/close valve disposed in the bypass line; a switch configured to output a signal to turn on or off control by the front control section; an input section; an on/off determining part configured to determine whether a signal input from the switch via the input section is an on signal that brings the control by the front control section into an on state or an off signal that brings the control by the front control section into an off state; an open/close command part configured to generate an open command signal to open the bypass valve when the on/off determining part determines that the signal input from the switch is the off signal and generate a close command signal to close the bypass valve when the on/off determining part determines that the signal input from the switch is the on signal; and an output section configured to output to the bypass valve the open command signal or the close command signal generated by the open/close command part.

Effects of the Invention

The aspect of the present invention can achieve both responsiveness of an actuator to an operation and front control functionality.

MODES FOR CARRYING OUT THE INVENTION

Embodiments of the present invention will be described below with reference to the accompanying drawings.

FIRST EMBODIMENT

1-1 Work Machine

Figure 1:
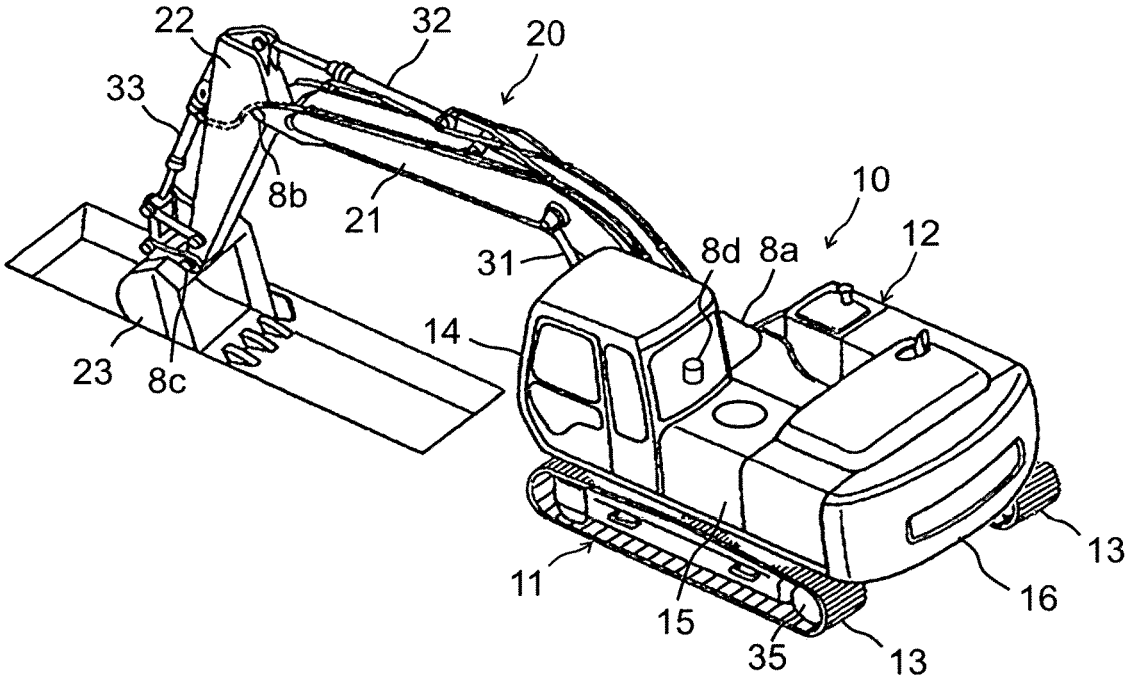
FIG. 1 is a perspective view of an appearance of a work machine according to a first embodiment of the present invention.

FIG. 1 is a perspective view of an appearance of a work machine according to a first embodiment of the present invention. The present embodiment illustrates, as the work machine, a hydraulic excavator including a bucket 23 as an attachment at a distal end of a front work implement. It should be noted that the present invention is applicable to other types of work machines such as a hydraulic excavator and a bulldozer including other types of attachments than the bucket. In the following, a front side (upper left side in FIG. 1), a rear side (lower right side in FIG. 1), a left side (lower left side in FIG. 1), and a right side (upper right side in FIG. 1) as viewed from an operator sitting in a driver's seat will be considered as front, rear, left, and right of the hydraulic excavator and simply referred to as a front side, a rear side, a left side, and a right side.

The hydraulic excavator shown in FIG. 1 includes a machine body 10 and a front work implement 20. The machine body 10 includes a track structure 11 and a machine body main unit 12.

The track structure 11 includes left and right crawlers (track drive structure) 13 having endless crawler belts in the present embodiment. The track structure 11 travels when the left and right crawlers 13 are driven by left and right track motors 35, respectively. Hydraulic motors, for example, are used for the track motors 35.

Figure 2:
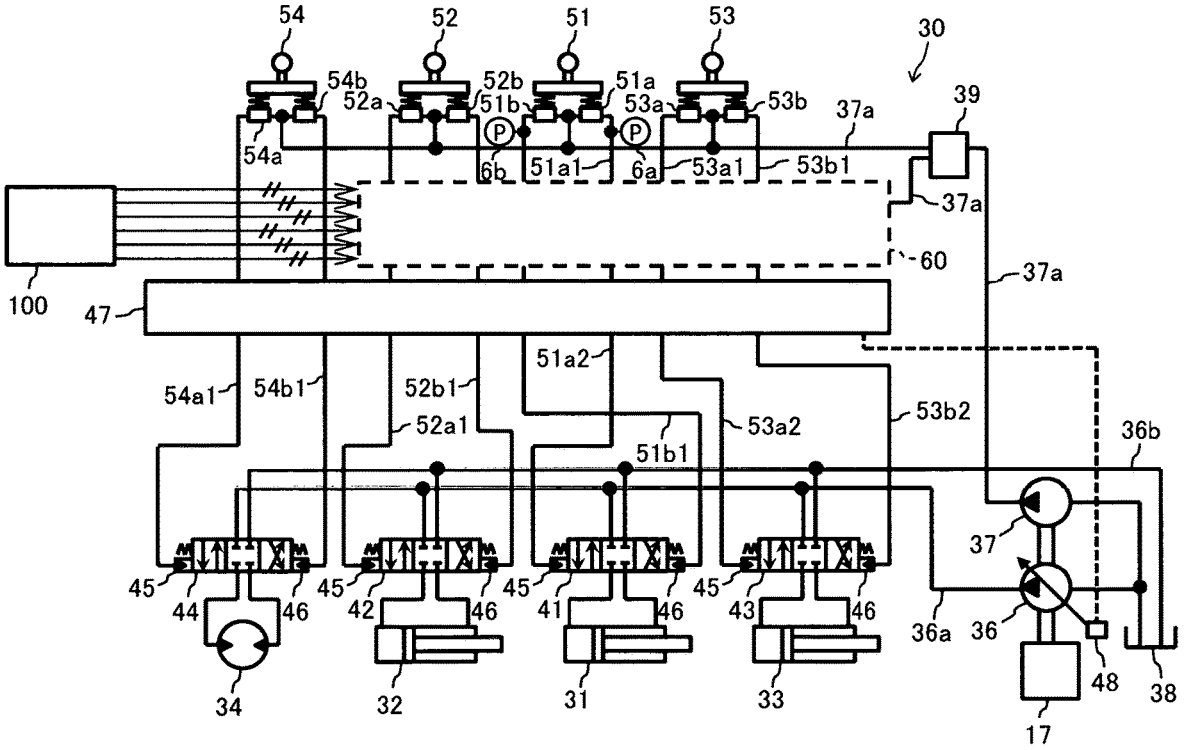
FIG. 2 is a diagram showing a hydraulic drive system included in a hydraulic excavator shown in FIG. 1, together with a controller unit.

The machine body main unit 12 is a swing structure disposed swingably on the track structure 11 via a swing unit (not shown). A cab 14 is provided at a front portion (left side of the front portion in the present embodiment) of the machine body main unit 12. The operator rides in the cab 14. A power chamber 15 is disposed behind the cab 14 in the machine body main unit 12. The power chamber 15 houses an engine, a hydraulic drive system, and the like. Additionally, a counterweight 16 is disposed at the rearmost portion of the machine body main unit 12. The counterweight 16 adjusts balance of the machine in a fore-aft direction. The swing structure that couples the machine body main unit 12 to the track structure 11 includes a swing motor 34 (FIG. 2). The swing motor 34 swingably drives the machine body main unit 12 with respect to the track structure 11. A hydraulic motor, for example, is used for the swing motor 34.

The front work implement 20 performs work such as excavation of earth and sand. The front work implement 20 is disposed at a front portion of the machine body main unit 12 (on the right of the cab 14 in the present embodiment). The front work implement 20 is a multi-articulated work implement including a boom 21, an arm 22, and a bucket 23. The boom 21 is coupled with a frame of the machine body main unit 12 by a pin (not shown) extending laterally. The boom 21 is also coupled with the machine body main unit 12 by a boom cylinder 31. The boom 21 rotatably moves up and down with respect to the machine body main unit 12 as the boom cylinder 31 extends and contracts. The arm 22 is coupled with a distal end of the boom 21 by a pin (not shown) extending laterally. The arm 22 is also coupled with the boom 21 by an arm cylinder 32. The arm 22 rotatably moves up and down with respect to the boom 21 as the arm cylinder 32 extends and contracts. The bucket 23 is coupled with a distal end of the arm 22 by a pin (not shown) extending horizontally and laterally. The bucket 23 is also coupled with the arm 22 by a bucket cylinder 33. The bucket 23 rotatably moves up and down with respect to the arm 22 as the bucket cylinder 33 extends and contracts. The boom cylinder 31, the arm cylinder 32, and the bucket cylinder 33 are each a hydraulic cylinder configured to drive the front work implement 20.

The hydraulic excavator further includes sensors configured to detect information on positions and posture. Such sensors are disposed at appropriate positions. For example, the boom 21, the arm 22, and the bucket 23 are provided with angle sensors 8*a* to 8*c*, respectively, disposed at respective rotational pivot points thereof. The angle sensors 8*a* to 8*c* are used as posture sensors configured to detect information on positions and posture of the front work implement 20. The angle sensors 8*a* to 8*c* detect rotation angles of the boom 21, the arm 22, and the bucket 23, respectively. In addition, the machine body main unit 12 is provided with an inclination sensor 8*d*, positioning devices 9*a* and 9*b* (FIG. 4), a radio 9*c* (FIG. 4), a hydraulic drive system 30 (FIG. 2), and a controller unit 100 (for example, FIG. 4). The inclination sensor 8*d* is used as a posture detecting device for the machine body main unit 12, detecting inclination in at least either one of the fore-aft direction and a left-right direction of the machine body main unit 12. A real-time kinematic—global navigation satellite system (RTK-GNSS), for example, is used for the positioning devices 9*a* and 9*b* and the positioning devices 9*a* and 9*b* acquire position information of the machine body 10. The radio 9*c* receives correction information from a reference station GNSS (not shown). The positioning devices 9*a* and 9*b* and the radio 9*c* are each a device for detecting positions and orientation of the machine body main unit 12. Furthermore, an operation panel (not shown) or any one lever part of operation lever devices 51 to 54 (FIG. 2, for example) inside the cab 14 is provided with a switch 7 (see FIG. 3) that turns ON or OFF control by a front control section 120. The hydraulic drive system 30 and the controller unit 100 will be described below.

1-2 Hydraulic Drive System

FIG. 2 is a diagram showing a hydraulic drive system included in the hydraulic excavator shown in FIG. 1, together with the controller unit. Parts that have previously been described are identified by like reference numerals used in FIG. 1 and descriptions therefor will be omitted.

The hydraulic drive system 30 drives driven members of the hydraulic excavator and is housed in the power chamber 15. The driven members include the front work implement 20 (the boom 21, the arm 22, and the bucket 23) and the machine body 10 (the crawlers 13 and the machine body main unit 12). The hydraulic drive system 30 includes hydraulic actuators 31 to 34, a hydraulic pump 36, control valves 41 to 44, a pilot pump 37, the operation lever devices 51 to 54, and a front control hydraulic unit 60.

1-2.1 Hydraulic Actuators

The hydraulic actuator (31 to 34) is a generic name for the boom cylinder 31, the arm cylinder 32, the bucket cylinder 33, and the swing motor 34. The track motors 35 are omitted in FIG. 2. A plurality of the boom cylinder 31, the arm cylinder 32, the bucket cylinder 33, and the swing motor 34 may be collectively referred to in the following as, for example, the "hydraulic actuators 31 to 34," the "hydraulic actuators 31 and 32," or the like. The hydraulic actuators 31 to 35 are driven by hydraulic operating fluid delivered from the hydraulic pump 36.

1-2.2 Hydraulic Pump

The hydraulic pump 36 is a variable displacement pump that serves as a drive source for, for example, the hydraulic actuators 31 to 34 and that is driven by a prime mover 17. The prime mover 17 in the present embodiment is an engine that converts combustion energy of, for example, an internal combustion engine into drive power. The hydraulic pump 36, though only one is shown in FIG. 2, may be provided in plurality. The hydraulic operating fluid delivered from the hydraulic pump 36 flows through a delivery line 36*a* to be supplied to each of the hydraulic actuators 31 to 34 by way of the respective control valves 41 to 44. Return hydraulic operating fluid from the hydraulic actuators 31 to 34 flows into a return fluid line 36*b* via the respective control valves 41 to 44 before being returned to a tank 38. A relief valve (not shown) that restricts maximum pressure of the delivery line 36*a* is disposed in the delivery line 36*a*. Though not shown in FIG. 2, the track motors 35 are driven through a similar circuit configuration. In a configuration in which an earth moving board is mounted at least at front or rear of the track structure 11 or in which an attachment including an actuator such as a breaker is mounted in place of the bucket 23 on the front work implement 20, the hydraulic actuator of the earth moving board or the attachment is driven through a similar circuit configuration.

1-2.3 Control Valves

Of the control valves 41 to 44, the control valve 41 is for the boom cylinder, the control valve 42 is for the arm cylinder, the control valve 43 is for the bucket cylinder, and the control valve 44 is for the swing motor. FIG. 2 omits showing a control valve for the track motor. The control valves 41 to 44 are each a hydraulically driven flow control valve configured to control a flow (direction and flow rate) of the hydraulic operating fluid supplied to the corresponding hydraulic actuator from the hydraulic pump 36. The control valves 41 to 44 each include hydraulic drive parts 45 and 46 to which hydraulic signals are applied. The control valves 41 to 44 are each configured so as to move to the left or right in FIG. 2 when a hydraulic signal is applied to the hydraulic drive part 45 or 46 and to be returned to a neutral position by a spring force when the application of the hydraulic signal is stopped. When, for example, a hydraulic signal is applied to the hydraulic drive part 45 of the control valve 41 for the boom cylinder, a spool of the control valve 41 moves to the right in FIG. 2 over a distance corresponding to a magnitude of the hydraulic signal. This causes hydraulic operating fluid to be supplied from the hydraulic pump 36 to a bottom-side hydraulic chamber of the boom cylinder 31 at a flow rate corresponding to the hydraulic signal, so that the boom cylinder 31 is extended at a speed corresponding to the magnitude of the hydraulic signal to thereby raise the boom 21.

1-2.4 Pilot Pump

The pilot pump 37 is a fixed displacement pump that serves as a drive source for control valves of, for example, the control valves 41 to 44. As with the hydraulic pump 36, the pilot pump 37 is driven by the prime mover 17. A pump line 37*a* as a delivery line of the pilot pump 37 extends to pass through a lock valve 39 before being branched into a plurality of lines to be connected with respective valves of the operation lever devices 51 to 54 and the front control hydraulic unit 60.

The lock valve 39 in the present example is a solenoid selector valve having a solenoid drive part connected electrically with a position sensor of a gate lock lever (not shown) disposed in the cab 14 (FIG. 1). The gate lock lever is disposed on an egress/ingress side of the driver's seat so as to prevent the operator from getting off the vehicle when the gate lock lever is in a lowered closed position. To get off the vehicle, the operator is required to raise the gate lock lever to thereby release an egress/ingress part for the driver's seat. The gate lock lever in the lowered position will be referred to as an "unlocked position" of an operation system and the gate lock lever in the raised position will be referred to as a "locked position" of the operation system. The position sensor detects the position of the gate lock lever and applies a signal corresponding to the position of the gate lock lever to the lock valve 39. When the gate lock lever is in the locked position, the lock valve 39 is closed to interrupt the pump line 37*a*; when the gate lock lever is in the unlocked position, the lock valve 39 opens to bring the pump line 37*a* into communication. When the pump line 37*a* is interrupted, source pressure for the operation lever devices 51 to 54 is interrupted and thus no hydraulic signals are applied to the control valves 41 to 44 regardless of whether an operation is performed. Specifically, the operation through the operation lever devices 51 to 54 is disabled and swing, excavation, and other operations are prohibited.

1-2.5 Operation Lever Devices

The operation lever devices 51 to 54 are lever-operated devices configured to generate and output hydraulic signals directing operations for the respective hydraulic actuators 31 to 34 in response to a control operation. The operation lever devices 51 to 54 are disposed in the cab 14 (FIG. 1). Of the operation lever devices 51 to 54, the operation lever device 51 is for boom operation, the operation lever device 52 is for arm operation, the operation lever device 53 is for bucket operation, and the operation lever device 54 is for swing operation. With a hydraulic excavator, the operation lever devices 51 to 54 are typically operated in orthogonal directions. Lowering the operation lever in the fore-aft direction directs to operate one hydraulic actuator and lowering the operation in the left-right direction directs to operate another hydraulic actuator. Thus, the four operation lever devices 51 to 54 are divided into two groups, each including two operation lever devices. Each group has one lever part shared between the two operation lever devices. Thus, the operation lever devices 51 to 54 have a total of two lever parts, one for right-hand operation and the other for left-hand operation. If the lever part is provided with the switch 7 as described previously, the switch 7 is disposed in at least either one of the two lever parts. FIG. 2 omits showing the operation lever device for traveling.

The operation lever device 51 for boom operation includes a signal output valve 51*a* for a boom raising command and a signal output valve 51*b* for a boom lowering command. The pump line 37*a* is connected with an input port (primary port) of each of the signal output valves 51*a* and 51*b*. The signal output valve 51*a* for the boom raising command has an output port (secondary port) connected with the hydraulic drive part 45 of the control valve 41 for boom cylinder via pilot lines 51*a*1 and 51*a*2. The signal output valve 51*b* for the boom lowering command has an output port connected with the hydraulic drive part 46 of the control valve 41 via a pilot line 51*b*1. When, for example, the operation lever device 51 is lowered to the boom raising command side, the signal output valve 51*a* opens to a degree corresponding to an operation amount. This causes a delivery fluid of the pilot pump 37 applied from the pump line 37*a* to undergo reduction in pressure corresponding to the operation amount of the signal output valve 51*a* and to be output as a hydraulic signal with respect to the hydraulic drive part 45 of the control valve 41. Pressure sensors 6*a* and 6*b* are disposed in the pilot lines 51*a*1 and 51*b*1, respectively. The pressure sensors 6*a* and 6*b* detect magnitude of pressure signals (pressure values) output by the signal output valves 51*a* and 51*b*, respectively.

Similarly, the operation lever device 52 for arm operation includes a signal output valve 52*a* for an arm crowding command and a signal output valve 52*b* for an arm dumping command. The operation lever device 53 for bucket operation includes a signal output valve 53*a* for a bucket crowding command and a signal output valve 53*b* for a bucket dumping command. The operation lever device 54 for swing operation includes a signal output valve 54*a* for a clockwise swing command and a signal output valve 54*b* for a counterclockwise swing command. The signal output valves 52*a*, 52*b*, 53*a*, 53*b*, 54*a*, and 54*b* each have an input port connected with the pump line 37*a*. The signal output valves 52*a* and 52*b* of the operation lever device 52 for arm operation have output ports connected with the hydraulic drive parts 45 and 46 of the control valve 42 for the arm cylinder via pilot lines 52*a*1 and 52*b*1, respectively. The signal output valve 53*a* for the bucket crowding command has an output port connected with the hydraulic drive part 45 of the control valve 43 for the bucket cylinder via pilot lines 53*a*1 and 53*a*2. The signal output valve 53*b* for the bucket dumping command has an output port connected with the hydraulic drive part 46 of the control valve 43 via pilot lines 53*b*1 and 53*b*2. The signal output valves 54*a* and 54*b* of the operation lever device 54 for swing operation have output ports connected with the hydraulic drive parts 45 and 46 of the control valve 44 for the swing motor via pilot lines 54*a*1 and 54*b*1, respectively. A principle of output applicable to the hydraulic signals of the operation lever devices 52 to 54 is similar to that of the operation lever device 51 for boom operation.

It is noted that, in the present embodiment, a shuttle block 47 is disposed in midway the pilot lines 51*a*2, 51*b*1, 52*a*1, 52*b*1, 53*a*2, 53*b*2, 54*a*1, and 54*b*1. The hydraulic signals output from the operation lever devices 51 to 54 are to be applied also to a regulator 48 of the hydraulic pump 36 via the shuttle block 47. While a detailed configuration of the shuttle block 47 is not described here, the hydraulic signal is applied to the regulator 48 via the shuttle block 47, which varies a delivery flow rate of the hydraulic pump 36 according to the hydraulic signal.

1-2.6 Front Control Hydraulic Unit

The front control hydraulic unit 60 is hardware that increases or decreases pressure of the hydraulic signals output from the operation lever devices 51 to 53 as necessary to thereby, for example, prevent the front work implement 20 from excavating below the target excavation surface. The front control hydraulic unit 60 is driven by a signal from the controller unit 100.

Figure 3:
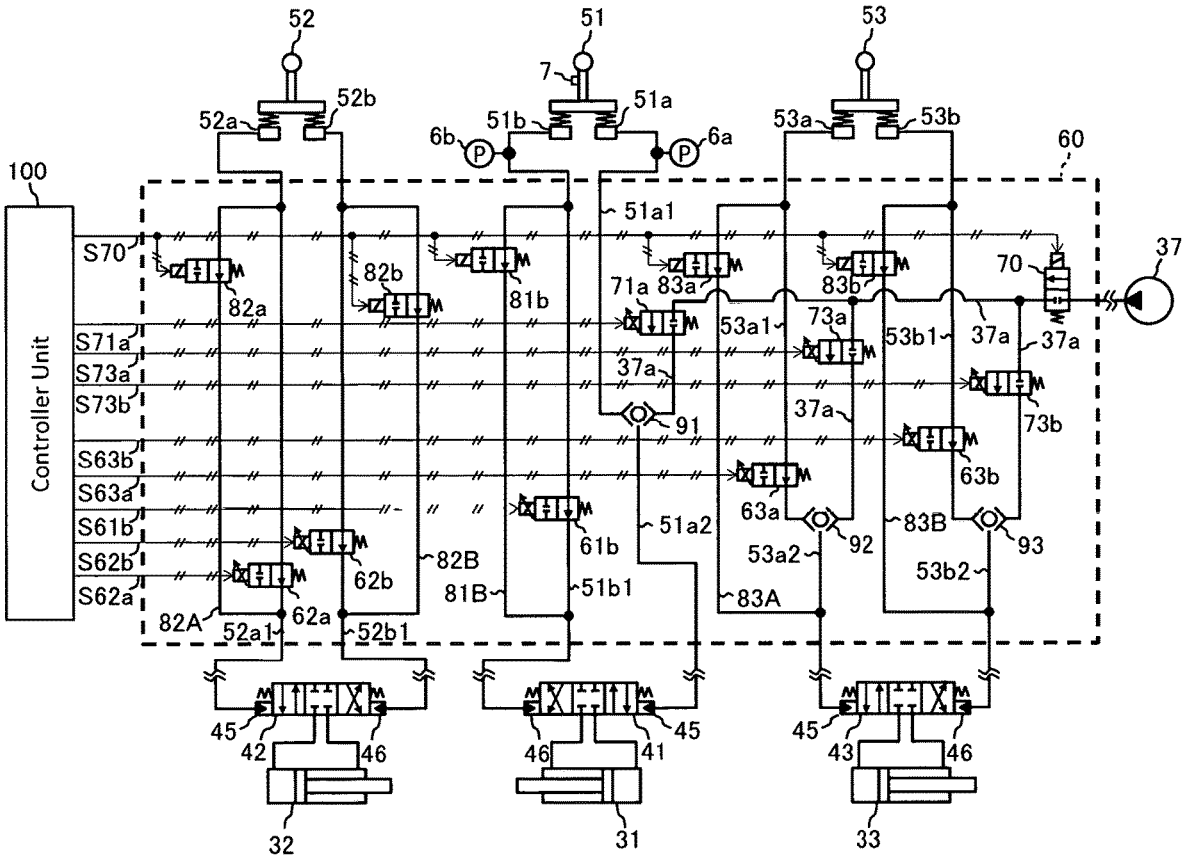
FIG. 3 is a hydraulic circuit diagram of a front control hydraulic unit included in the hydraulic excavator shown in FIG. 1.

FIG. 3 is a hydraulic circuit diagram of the front control hydraulic unit. In FIG. 3, like reference numerals denote like parts throughout various other drawings. The front control hydraulic unit 60 includes proportional solenoid valves 61*b*, 62*a*, 62*b*, 63*a*, and 63*b* for pressure decrease, proportional solenoid valves 71*a*, 73*a*, and 73*b* for pressure increase, a shut-off valve 70, bypass valves 81*b*, 82*a*, 82*b*, 83*a*, and 83*b*, and shuttle valves 91 to 93.

Shuttle Valves

The shuttle valves 91 to 93 are each a high-pressure selector valve including two inlet ports and one outlet port. The shuttle valve 91 has a first inlet port connected with the signal output valve 51*a* for the boom raising command via the pilot line 51*a*1 and has a second inlet port connected with the pilot pump 37, not via a signal output valve, but via the pump line 37*a*. The shuttle valve 91 has the outlet port connected with the hydraulic drive part 45 (boom raising side) of the control valve 41 for the boom cylinder via the pilot line 51*a*2. The shuttle valve 92 has a first inlet port connected with the signal output valve 53*a* for the bucket crowding command via the pilot line 53*a*1 and has a second inlet port connected with the pilot pump 37, not via a signal output valve, but via the pump line 37*a*. The shuttle valve 92 has the outlet port connected with the hydraulic drive part 45 (bucket crowding side) of the control valve 43 for the bucket cylinder via the pilot line 53*a*2. The shuttle valve 93 has a first inlet port connected with the signal output valve 53*b* for the bucket dumping command via the pilot line 53*b*1 and has a second inlet port connected with the pilot pump 37, not via a signal output valve, but via the pump line 37*a*. The shuttle valve 93 has the outlet port connected with the hydraulic drive part 46 (bucket dumping side) of the control valve 43 for the bucket cylinder via the pilot line 53*b*2.

Proportional Solenoid Valves for Pressure Decrease

The proportional solenoid valves 61*b*, 62*a*, 62*b*, 63*a*, and 63*b* are each a normally-open type proportional valve that opens to a maximum opening degree when de-energized and reduces the opening degree (closes) in proportion to the magnitude of a signal from the controller unit 100 when energized by the signal. The proportional solenoid valves are disposed in the pilot lines of the signal output valves associated with the respective proportional solenoid valves. In order to prevent a side below the target excavation surface from being excavated, these proportional solenoid valves function to limit a maximum value of a hydraulic signal output from the corresponding signal output valve according to the signal from the controller unit 100.

Specifically, the proportional solenoid valve 61*b* is disposed in the pilot line 51*b*1 of the signal output valve 51*b* for the boom lowering command and limits the maximum value of the hydraulic signal for the boom lowering command according to a signal S61*b* of the controller unit 100. The proportional solenoid valve 62*a* is disposed in the pilot line 52*a*1 of the signal output valve 52*a* for the arm crowding command and limits the maximum value of the hydraulic signal for the arm crowding command according to a signal S62*a* of the controller unit 100. The proportional solenoid valve 62*b* is disposed in the pilot line 52*b*1 of the signal output valve 52*b* for the arm dumping command and limits the maximum value of the hydraulic signal for the arm dumping command according to a signal S62*b* of the controller unit 100. The proportional solenoid valve 63*a* is disposed in the pilot line 53*a*1 of the signal output valve 53*a* for the bucket crowding command and limits the maximum value of the hydraulic signal for the bucket crowding command according to a signal S63*a* of the controller unit 100. The proportional solenoid valve 63*b* is disposed in the pilot line 53*b*1 of the signal output valve 53*b* for the bucket dumping command and limits the maximum value of the hydraulic signal for the bucket dumping command according to a signal S63*b* of the controller unit 100.

Proportional Solenoid Valves for Pressure Increase

The proportional solenoid valves 71*a*, 73*a*, and 73*b* are each a normally-closed type proportional valve that opens to a minimum opening degree (zero opening degree) when de-energized and increases the opening degree (opens) in proportion to the magnitude of a signal from the controller unit 100 when energized by the signal. The proportional solenoid valves are disposed in the pump lines 37*a* leading to the shuttle valves. The proportional solenoid valves each function to output a hydraulic signal that bypasses the operation lever device to thereby be independent of the operation on the operation lever device according to the signal of the controller unit 100. Hydraulic signals applied to the inlet ports on the second side of the shuttle valves 91 to 93 from the proportional solenoid valves 71*a*, 73*a*, and 73*b* interfere with hydraulic signals from the operation lever devices 51 and 53 applied to the inlet ports on the first side of the shuttle valves 91 to 93. In this specification, the proportional solenoid valves 71*a*, 73*a*, and 73*b* are referred to as the proportional solenoid valves for pressure increase in that these proportional solenoid valves are capable of outputting hydraulic signals of pressure higher than the hydraulic signals output from the operation lever devices 51 and 53.

Specifically, the proportional solenoid valve 71*a* is disposed in the pump line 37*a* leading to the shuttle valve 91 and outputs a hydraulic signal for a boom automatic raising operation according to a signal S71*a* of the controller unit 100. Even when a boom lowering operation is performed at this time, the boom raising operation is forcibly performed if the hydraulic signal applied from the proportional solenoid valve 71*a* to the hydraulic drive part 46 is greater than the hydraulic signal applied to the hydraulic drive part 45 of the control valve 41. The proportional solenoid valve 71*a* functions when, for example, the side below the target excavation surface is being excavated.

The proportional solenoid valve 73*a* is disposed in the pump line 37*a* leading to the shuttle valve 92 and outputs a hydraulic signal directing a bucket crowding operation according to a signal S73*a* of the controller unit 100. The proportional solenoid valve 73*b* is disposed in the pump line 37*a* leading to the shuttle valve 93 and outputs a hydraulic signal directing a bucket damping operation according to a signal S73*b* of the controller unit 100. The hydraulic signals output from the proportional solenoid valves 73*a* and 73*b* correct posture of the bucket 23. Application of these hydraulic signals as selected by the shuttle valves 92 and 93 to the control valve 43 corrects the posture of the bucket 23 so as to achieve a predetermined angle with respect to the target excavation surface.

Shut-Off Valve

The shut-off valve 70 is a normally-closed type, solenoid-driven open/close valve (solenoid selector valve). The shut-off valve 70 fully closes (zero opening degree) when de-energized and is energized to open upon receipt of a signal from the controller unit 100. The shut-off valve 70 is disposed between a branch point in the pump line 37*a* branching to the shuttle valves 91 to 93 and the lock valve 39 (FIG. 2). When the shut-off valve 70 is closed by a command signal from the controller unit 100, generation and output of a hydraulic signal not dependent on the operation of the operation lever devices 51 and 53 are prohibited.

Bypass Valves

The bypass valves 81*b*, 82*a*, 82*b*, 83*a*, and 83*b* are each a normally-open type, solenoid-driven open/close valve (solenoid selector valve). The bypass valves 81*b*, 82*a*, 82*b*, 83*a*, and 83*b* each fully open when de-energized and is energized to fully close (zero opening degree) upon receipt of a signal from the controller unit 100. In the present embodiment, the bypass valves 81*b*, 82*a*, 82*b*, 83*a*, and 83*b*, because sharing a signal line with the shut-off valve 70, open and close inversely with respect to the shut-off valve 70. The bypass valves 81*b*, 82*a*, 82*b*, 83*a*, and 83*b* are disposed so as to constitute parallel circuits with the proportional solenoid valves 61*b*, 62*a*, 62*b*, 63*a*, and 63*b*, respectively, for pressure decrease. For example, a bypass line 81B, which connects an upstream side and a downstream side of the proportional solenoid valve 61*b* to thereby bypass the proportional solenoid valve 61*b*, is connected with the pilot line 51*b*1 of the signal output valve 51*b* for the boom lowering command. The bypass valve 81*b* is disposed in the bypass line 81B.

Similarly, a bypass line 82A, which bypasses the proportional solenoid valve 62*a*, is connected with the pilot line 52*a*1 of the signal output valve 52*a* for the arm crowding command. The bypass valve 82*a* is disposed in the bypass line 82A. A bypass line 82B, which bypasses the proportional solenoid valve 62*b*, is connected with the pilot line 52*b*1 of the signal output valve 52*b* for the arm dumping command. The bypass valve 82*b* is disposed in the bypass line 82B. A bypass line 83A, in which the bypass valve 83*a* is disposed, bypasses the proportional solenoid valve 63*a* to thereby bring the pilot lines 53*a*1 and 53*a*2 of the signal output valve 53*a* for the bucket crowding command into communication. A bypass line 83B, in which the bypass valve 83*b* is disposed, bypasses the proportional solenoid valve 63*b* to thereby bring the pilot lines 53*b*1 and 53*b*2 of the signal output valve 53*b* for the bucket dumping command into communication.

1-2.7 Controller Unit

Figure 4:
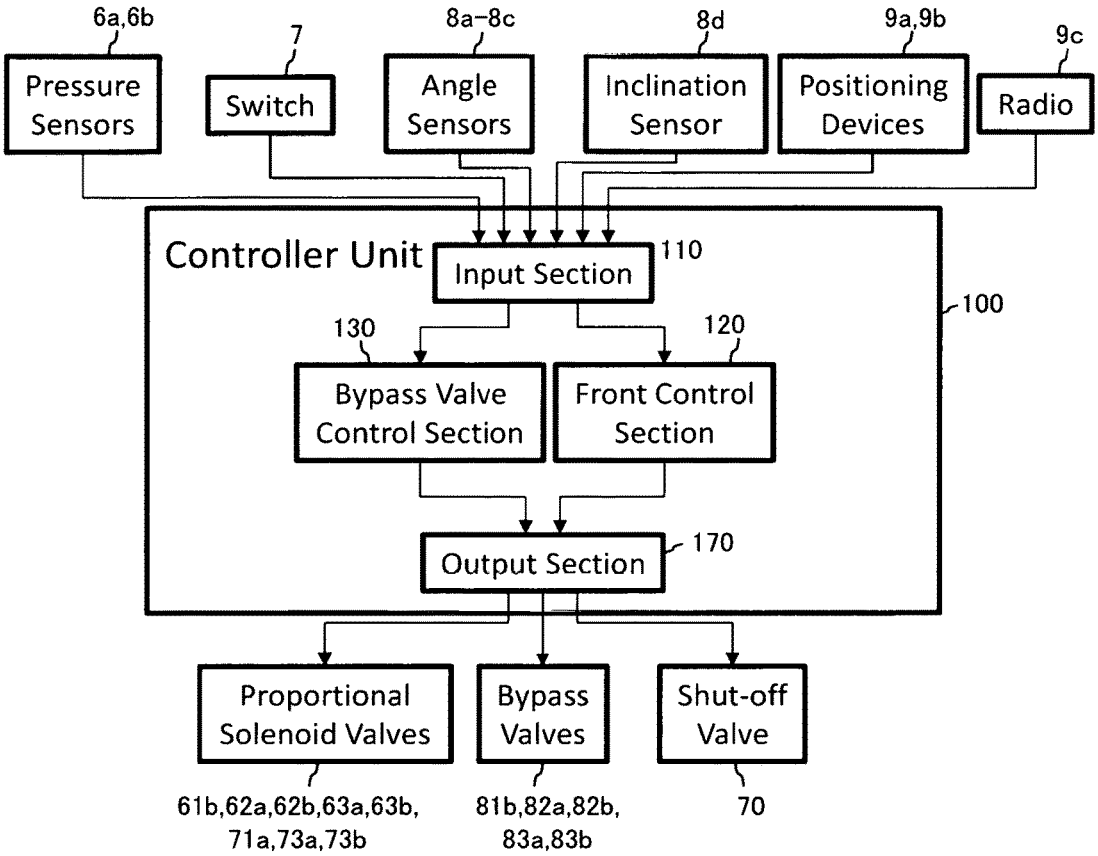
FIG. 4 is a functional block diagram of the controller unit included in the hydraulic excavator shown in FIG. 1.

FIG. 4 is a functional block diagram of the controller unit. As shown in FIG. 4, the controller unit 100 includes an input section 110, the front control section 120, a bypass valve control section 130, an output section 170, and other functional sections. Each of the functional sections will be described below.

Input Section and Output Section

The input section 110 is a functional section that receives inputs of signals from, for example, sensors. Signals from, for example, the pressure sensors 6*a* and 6*b*, the switch 7, the angle sensors 8*a* to 8*c*, the inclination sensor 8*d*, the positioning devices 9*a* and 9*b*, and the radio 9*c* are applied to the input section 110.

The output section 170 is a functional section configured to output to the front control hydraulic unit 60 command signals generated by the front control section 120 and the bypass valve control section 130 to thereby control operation of the respective valves. The valves to be controlled include the proportional solenoid valves 61*b*, 62*a*, 62*b*, 63*a*, 63*b*, 71*a*, 73*a*, and 73*b*, the bypass valves 81*b*, 82*a*, 82*b*, 83*a*, and 83*b*, and the shut-off valve 70.

Front Control Section

The front control section 120 is a functional section configured to calculate a limit command value for restricting operations of the front work implement 20 so as not to allow the front work implement 20 to excavate below the target excavation surface (the side below the target excavation surface) using the signals from the angle sensors 8*a* to 8*c* and the inclination sensor 8*d*. The term "front control" as used herein refers to generally controlling the front control hydraulic unit 60 using, for example, a distance between the target excavation surface and a specific point in the bucket 23 and an extension/contraction speed of the hydraulic actuators 31 to 33. An example of the front control is to control at least one of the proportional solenoid valves for pressure decrease 61*b*, 62*a*, 62*b*, 63*a*, and 63*b* to thereby reduce a speed of operation of at least one of the hydraulic actuators 31 to 33 at a position near the target excavation surface. Other examples of the front control include controlling at least one of the proportional solenoid valves for pressure increase 71*a*, 73*a*, and 73*b* to thereby perform boom automatic raising control that forcibly raises the boom in a situation in which the side below the target excavation surface is being excavated, and maintaining a predetermined angle for the bucket 23. Other types of the front control include what is called boom lowering stop control and bucket pressure increase control. In addition, the front control further encompasses control of at least one of the proportional solenoid valves for pressure decrease 61*b*, 62*a*, 62*b*, 63*a*, and 63*b* and at least one of the proportional solenoid valves for pressure increase 71*a*, 73*a*, and 73*b* in combination. Moreover, this specification also considers as a type of front control what is called locus control that causes a locus drawn by the front work implement 20 to fall on a predetermined locus. The front control section 120 will be described in detail later. Well-known techniques disclosed in, for example, JP-A-8-333768 and JP-A-2016-003442 can be applied as appropriate to the front control section 120.

Bypass Valve Control Section

Figure 5:
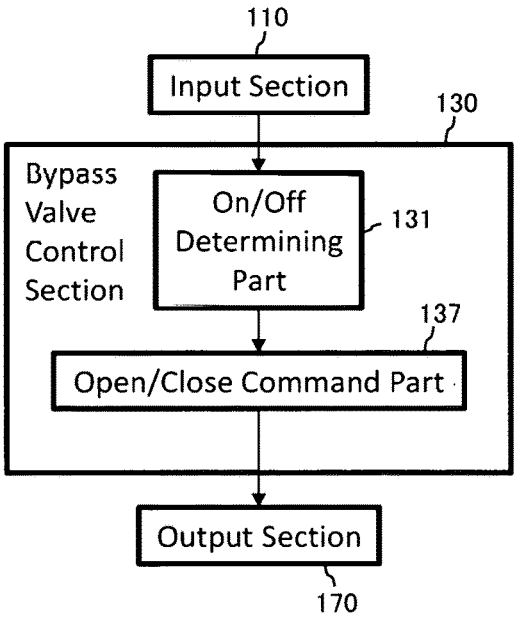
FIG. 5 is a functional block diagram of a bypass valve control section included in the hydraulic excavator shown in FIG. 1.

FIG. 5 is a functional block diagram of the bypass valve control section. As shown in FIG. 5, the bypass valve control section 130 includes an on/off determining part 131 and an open/close command part 137.

The on/off determining part 131 is a functional part configured to determine whether a signal applied via the input section 110 from the switch 7 is an on signal indicating that control by the front control section 120 is in an on state or an off signal indicating that the control by the front control section 120 is an off state.

The open/close command part 137 is a functional part that selectively generates an open command signal to open the bypass valves 81*b*, 82*a*, 82*b*, 83*a*, and 83*b* and a close command signal to close the bypass valves 81*b*, 82*a*, 82*b*, 83*a*, and 83*b*. Specifically, when the on/off determining part 131 determines that the signal applied from the switch 7 is the off signal, the open/close command part 137 generates an open command signal. In contrast, when the on/off determining part 131 determines that the signal applied from the switch 7 is the on signal, the open/close command part 137 generates a close command signal.

It is noted that, in the present embodiment, the bypass valves 81*b*, 82*a*, 82*b*, 83*a*, and 83*b* open or close inversely with respect to the shut-off valve 70 and the bypass valves 81*b* and the like are an normally-open type and the shut-off valve 70 is a normally-closed type. Thus, by sharing a signal line between the bypass valves 81*b* and the like and the shut-off valve 70, the above-described open command signal serves also as a signal to close the shut-off valve 70 and the above-described close command signal serves also as a signal to open the shut-off valve 10. Because the bypass valves 81*b*, 82*a*, 82*b*, 83*a*, and 83*b* are normally-open type solenoid valves, the open command is de-energization and the close command is energization. Thus, when the bypass valve control section 130 generates a close command signal, energization current is output to a solenoid drive part of the bypass valves 81*b* and the like via the output section 170; when an open command signal is generated, the output of the energization current is stopped. In the present embodiment, the energization or de-energization of the solenoid drive part is considered as the output of a close command signal or an open command signal from the output section 170.

1-3 Operation

Figure 6:
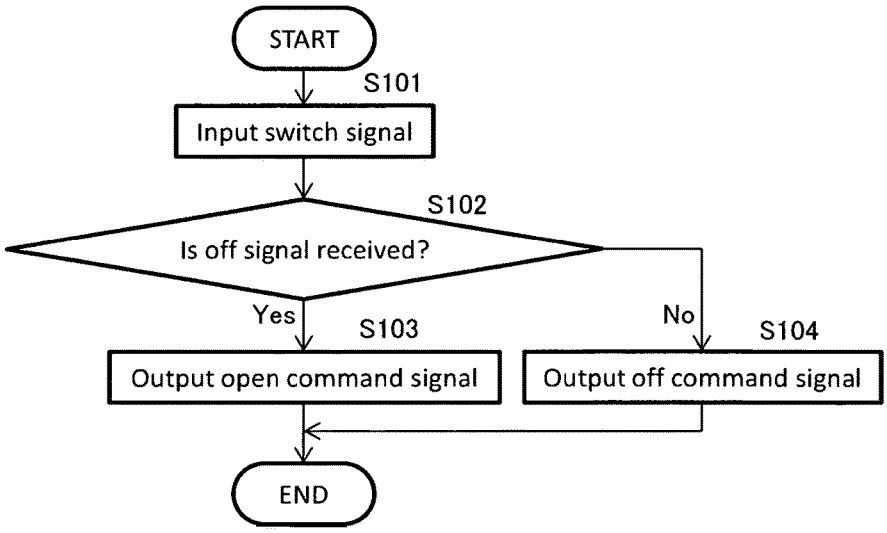
FIG. 6 is a flowchart of steps of bypass valve open/close control performed by the bypass valve control section shown in FIG. 5.

FIG. 6 is a flowchart of steps of bypass valve open/close control performed by the bypass valve control section. During operation, the bypass valve control section 130 repeatedly performs the steps shown in FIG. 6 at predetermined cycles (e.g., 0.1 seconds). A signal from the switch 7 is first applied via the input section 110 (Step S101) and the on/off determining part 131 determines whether the signal is an on signal or an off signal (Step S102). When it is determined that the signal from the switch 7 is an off signal, the bypass valve control section 130 causes the open/close command part 137 to generate an open command signal and outputs the open command signal via the output section 170 to bring, for example, the bypass line 81B into communication and the steps of FIG. 6 are terminated (Step S103). When it is determined that the signal from the switch 7 is an on signal, the bypass valve control section 130 causes the open/close command part 137 to generate a close command signal and outputs the close command signal via the output section 170 to thereby interrupt, for example, the bypass line 81B before terminating the steps of FIG. 6 (Step S104). The steps of FIG. 6 achieve the following. Specifically, when the switch 7 is operated to bring the front control function into an on state, the bypass valves 81*b*, 82*a*, 82*b*, 83*a*, and 83*b* are closed and the bypass lines 81B, 82A, 82B, 83A, and 83B are interrupted. In contrast, when the switch 7 is operated to bring the front control function into an off state, the bypass valves 81*b*, 82*a*, 82*b*, 83*a*, and 83*b* are opened and the bypass lines 81B, 82A, 82B, 83A, and 83B are brought into communication.

1-3.1 When Front Control is Enabled

When, for example, a boom lowering operation is performed on the operation lever device 51, the signal output valve 51*b* for the boom lowering command opens corresponding to an operation amount and a hydraulic signal is applied to the hydraulic drive part 46 of the control valve 41 for the boom cylinder via the pilot line 51*b*1. This contracts the boom cylinder 31 and the boom lowering operation is performed. When the front control function is in the on state, the opening degree of the proportional solenoid valve 61*b* is restricted by a limit command value output from the front control section 120 to thereby limit the maximum value of the hydraulic signal depending on the distance between the bucket 23 and the target excavation surface or a lowering speed. When the limit value specified by the opening degree of the proportional solenoid valve 61*b* is exceeded, the hydraulic signal is subjected to pressure reduction to the limit value by the proportional solenoid valve 61*b* during a flow through the pilot line 51*b*1. As a result, the boom lowering operation is decelerated from the speed originally intended by the operation amount and the bucket 23 is prevented from advancing into the side below the target excavation surface. Because the bypass line 81B is interrupted when the front control function is in the on state, a total amount of a pressure signal output from the signal output valve 51*b* passes through the proportional solenoid valve 61*b* without bypassing and the front control function acts in a similar fashion as when the bypass line 81B is omitted.

The same holds for operations (each of arm crowding, arm dumping, bucket crowding, and bucket dumping operations) in which a pressure signal is output to another pilot line in which a bypass valve is disposed in parallel with the proportional solenoid valve for pressure reduction.

1-3.2 When Front Control is Disabled

When, for example, a boom lowering operation is performed on the operation lever device 51, the signal output valve 51*b* for the boom lowering command opens corresponding to the operation amount. When the front control function is in the off state, the proportional solenoid valve 61*b* opens to the maximum opening degree regardless of, for example, the position of the bucket 23. Because, however, the bypass line 81B is brought into communication, the pressure signal output from the signal output valve 51*b* branches into the pilot line 51*b*1 and the bypass line 81B. The hydraulic signals flowing through the pilot line 51*b*1 and the bypass line 81B thereafter join before being applied to the hydraulic drive part 46 of the control valve 41 for the boom cylinder.

The same holds for operations (each of arm crowding, arm dumping, bucket crowding, and bucket dumping operations) in which a pressure signal is output to another pilot line in which a bypass valve is disposed in parallel with the proportional solenoid valve for pressure reduction.

1-4 Effects

Compared with a hydraulic excavator not having the front control function (hereinafter referred to as a "standard work machine" for convenience sake), the work machine in the present embodiment involves loss of the hydraulic signal flowing through the pilot line for the amount of pressure loss of, for example, the proportional solenoid valve 61*b*. Thus, when the front control function is turned off, the pressure loss of, for example, the proportional solenoid valve 61*b* acts on the hydraulic signal, resulting in responsiveness in operation of the hydraulic actuators 31 to 33 to the operation on the operation lever devices 51 to 53 being degraded compared with that of the standard work machine, though the proportional solenoid valve 61*b*, for example, achieves the maximum opening degree thereof.

Thus, the present embodiment is configured so as to include the bypass line 81B, for example, to bypass the proportional solenoid valve 61*b*, for example, and the bypass valve 81*b*, for example, that provides or interrupts communication through the bypass line 81B, for example. The present embodiment is further configured so as to provide communication through the bypass line 81B when the front control function is in the off state. When the front control function is in the off state, the bypass valve 81*b* opens, so that a total opening area of a flow path of the hydraulic signal increases for the opening area of the bypass valve 81*b*, for example. This reduces an effect of the pressure loss of the proportional solenoid valve 61*b*, for example, on the hydraulic signal. Thus, responsiveness equivalent to or close to that of the standard work machine can be achieved by opening the bypass valve 81*b*, for example, while having the proportional solenoid valve 61*b* for front control, for example. Thus, responsiveness in operation of the hydraulic actuators 31 to 33 to the operation on the operation lever devices 51 to 53 and the front control function can both be achieved.

Loss of the hydraulic signal is reduced when the bypass line 81B, for example, communicates, which contributes to enhanced energy efficiency of the hydraulic excavator having the front control function.

Additionally, the switch 7 is disposed in the lever part of any one of the operation lever devices 51 to 54. Thus, the bypass valve 81*b*, for example, can be easily opened or closed while the front work implement 20 is being operated through confirmation made of situations from the cab 14.

SECOND EMBODIMENT

The present embodiment differs from the first embodiment in being configured such that the bypass valves 81*b*, 82*a*, 82*b*, 83*a*, and 83*b* automatically open when the front work implement 20 is spaced a predetermined distance away from the target excavation surface even when the front control function is in the on state. To achieve this control, the present embodiment modifies the bypass valve control section. The bypass valve control section in the present embodiment is described next.

2-1 Bypass Valve Control Section

Figure 7:
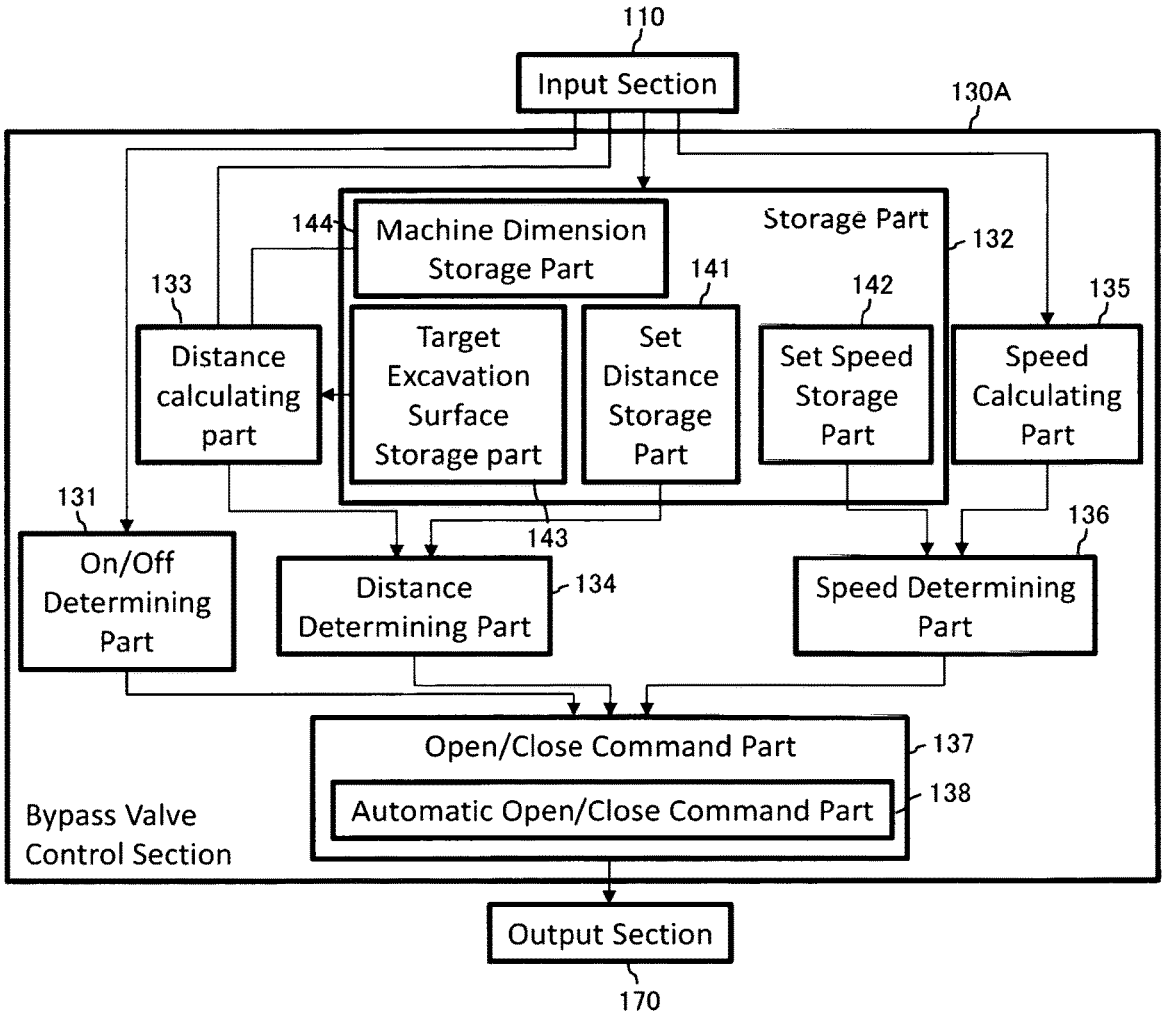
FIG. 7 is a functional block diagram of a bypass valve control section included in a work machine according to a second embodiment of the present invention.

FIG. 7 is a functional block diagram of a bypass valve control section included in a work machine according to a second embodiment of the present invention. In FIG. 7, parts that have previously been described are identified by like reference numerals and descriptions therefor will be omitted. This bypass valve control section 130A shown in FIG. 7 includes, in addition to an on/off determining part 131 and an open/close command part 137, a storage part 132, a distance calculating part 133, a distance determining part 134, a speed calculating part 135, and a speed determining part 136. In addition, the open/close command part 137 includes an automatic open/close command part 138.

Storage Part

The storage part 132 is a functional part configured to store various types of in. The storage part 132 includes a set distance storage part 141, a set speed storage part 142, a target excavation surface storage part 143, and a machine dimension storage part 144. The set distance storage part 141 is a storage space in which a set distance D0 (>0) established in advance with respect to a distance D between a specific point P in the front work implement 20 and a target excavation surface S is stored. The set speed storage part 142 is a storage space in which a set speed V0 (>0) established in advance with respect to an operating speed V of a specific hydraulic actuator (e.g., boom cylinder 31) is stored. The target excavation surface storage part 143 is a storage space in which the target excavation surface S is stored. The target excavation surface S constitutes a target landform to be formed (molded) through excavation by the hydraulic excavator. The target excavation surface S may be stored as being manually set in a coordinate system having a reference on the machine body main unit 12 or stored in advance as three-dimensional position information in the earth coordinate system. The three-dimensional position information of the target excavation surface S represents topographical data representing the target excavation surface S in a polygon, to which position data is added. The three-dimensional position information of the target excavation surface S is prepared in advance. The machine dimension storage part 144 is a storage space in which dimensions of different parts of the front work implement 20 and the machine body main unit 12 are stored.

Distance Calculating Part

The distance calculating part 133 is a functional part configured to calculate the distance D between the specific point P in the front work implement 20 and the target excavation surface S using detection signals of the angle sensors 8*a* to 8*c* applied via the input section 110. An example of calculation of the distance D will be described later.

Distance Determining Part

The distance determining part 134 is a functional part configured to determine whether the distance D between the specific point P and the target excavation surface S calculated by the distance calculating part 133 is greater than the set distance D0 read from the set distance storage part 141.

Speed Calculating Part

The speed calculating part 135 is a functional part configured to calculate the operating speed V (extension/contraction speed) of a specific hydraulic actuator, specifically in this example, the boom cylinder 31 using signals of the pressure sensors 6*a* and 6*b* applied via the input section 110. For example, the speed calculating part 135 includes a storage part configured to store a flow rate characteristic (for example, a relation between the flow rate of hydraulic working fluid to be circulated and the opening degree) of the control valve 41 for the boom cylinder. The opening degree of the control valve 41 has a correspondence relation with the magnitude of the hydraulic signal to the control valve 41, detected by the pressure sensors 6*a* and 6*b*. The speed calculating part 135 calculates the operating speed V of the boom cylinder 31 on the basis of the foregoing and using the flow rate characteristic of the control valve 41 and the signals detected by the pressure sensors 6*a* and 6*b*. It is noted that the speed calculating part 135 selects whichever is greater of the signals detected by the pressure sensors 6*a* and 6*b* as a basis for the calculation of the operating speed of the boom cylinder 31. The basis for the calculation, specifically, a specific signal out of the signals detected by the pressure sensors 6*a* and 6*b* determines the specific type of operating speed V to be calculated, specifically, whether the operating speed V to be calculated is an extension speed or a contraction speed of the boom cylinder 31. Understandably, the operating speed V calculated on the basis of the signal of the pressure sensor 6*b* detecting the pressure signal for a boom lowering command is the contraction speed of the boom cylinder 31 corresponding to the boom lowering operation. The operating speed V is positive toward the contraction direction of the boom cylinder 31, so that the extension speed is treated as a negative speed.

Speed Determining Part

The speed determining part 136 is a functional part configured to determine whether the operating speed V of the boom cylinder 31 calculated by the speed calculating part 135 is greater than the set speed V0 read from the set speed storage part 142.

Open/Close Command Part

The automatic open/close command part 138 included in the open/close command part 137 is a functional part configured to generate an open command signal under predetermined conditions even when the front control function is in the on state. The following are the three conditions under which the automatic open/close command part 138 generates an open command signal:

First condition: The signal from the switch 7 is an on signal;

Second condition: A determination signal applied from the distance determining part 134 indicates a determination result that the distance D between the specific point P and the target excavation surface S is greater than the set distance D0; and Third condition: A determination signal applied from the speed determining part 136 indicates a determination result that the operating speed V of a specific hydraulic actuator (the boom cylinder 31 in this example) is lower than the set speed V0.

When the first condition is satisfied, the function of the automatic open/close command part 138 in the open/close command part 137 is turned on and a step by the automatic open/close command part 138 is performed. When the second and third conditions are additionally satisfied, the automatic open/close command part 138 generates an open command signal. Specifically, in the open/close command part 137, in combination with the step performed by the automatic open/close command part 138, when the first to third conditions are simultaneously satisfied and the front control function is in the off state, an open command signal is generated and, in any other cases, a close command signal is generated.

The work machine in the present embodiment has configurations similar to those in the work machine in the first embodiment in other hardware.

Figure 8:
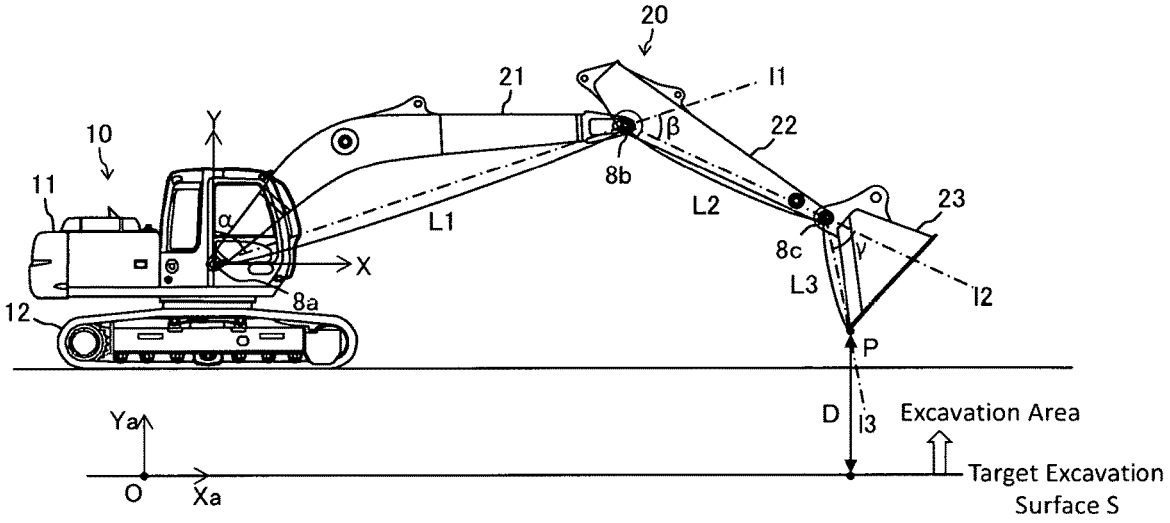
FIG. 8 is a diagram illustrating a method for calculating a distance between a specific point in a work implement and a target excavation surface, performed by a distance calculating part included in the bypass valve control section shown in FIG. 7.

2-2 Example of Calculation of Distance Between Specific Point and Target Excavation Surface FIG. 8 is a diagram illustrating a method for calculating the distance between the specific point in the work implement and the target excavation surface, performed by the distance calculating part. FIG. 8 is a view of an operating plane (plane orthogonal to a rotational axis of the boom 21, for example) of the front work implement 20 as viewed from a direction orthogonal to the operating plane (direction in which the rotational axis of the boom 21, for example, extends). FIG. 8 omits showing the hydraulic actuators 31 to 33 to avoid complexity.

In FIG. 8, the specific point P is set at a position of a distal end (tip end) of the bucket 23. The specific point P, though typically set at the distal end of the bucket 23, may be set at any other portion in the front work implement 20. The distance calculating part 133 receives inputs from the angle sensors 8*a* to 8*c* via the input section 110 and an input of information on the target excavation surface S from the target excavation surface storage part 143. To calculate the distance D in the earth coordinate system, the distance calculating part 133 additionally receives via the input section 110 inputs of a detection signal of the inclination sensor 8*d*, position information of the machine body 10 acquired by the positioning devices 9*a* and 9*b*, and the correction information received by the radio 9*c*. To find the distance D in the earth coordinate system, the distance calculating part 133 corrects the position information acquired by the positioning devices 9*a* and 9*b* with the correction information to thereby calculate the position and orientation of the machine body 10 and uses the signal from the inclination sensor 8*d* to calculate inclination of the machine body 10.

The target excavation surface S is defined as a line of intersection with the operating plane of the front work implement 20 and, together with information on the position, orientation, inclination, and the like of the machine body 10, the positional relation between the target excavation surface S and the machine body 10 is identified in the earth coordinate system. A range on the upper side of the target excavation surface S is defined as an excavation area in which the specific point P can be moved. The target excavation surface S is temporarily defined, for example, by at least one linear expression in an X-Y coordinate system with reference to the hydraulic excavator. The X-Y coordinate system is, for example, an orthogonal coordinate system having the rotational pivot point of the boom 21 as an origin, an axis passing through the origin and extending in parallel with a swing central axis of the machine body main unit 12 defined as a Y-axis (positive in the upward direction), and an axis intersecting the Y-axis at the origin and extending toward the front (positive in the forward direction) defined as an X-axis. It is noted that the positional relation between the target excavation surface S and the machine body 10 is known when the target excavation surface S is manually set.

The target excavation surface S defined in the X-Y coordinate system is redefined in an Xa-Ya coordinate system that assumes an orthogonal coordinate system having an origin O and the target excavation surface S defined as one axis (Xa-axis). Understandably, a Ya-axis has an origin O and is orthogonal to the Xa-axis. The Xa-axis is positive toward the front direction and the Ya-axis is positive toward the upward direction.

The distance calculating part 133 calculates the position of the bucket specific point P using dimension data (L1, L2, and L3) of the front work implement 20 read from the machine dimension storage part 144 and values of rotation angles α, β, and δ detected by the angle sensors 8*a*, 8*b*, and 8*c*, respectively. The position of the specific point P is obtained, for example, as coordinate values (X, Y) in the X-Y coordinate system with reference to the hydraulic excavator. The coordinate values (X, Y) of the specific point P can be obtained using expression (1) and expression (2) given below:

$$X=L1\cdot\sin\alpha+L2\cdot\sin(\alpha+\beta)+L3\cdot\sin(\alpha+\beta+\gamma) \quad (1)$$

$$Y=L1\cdot\cos\alpha+L2\cdot\cos(\alpha+\beta)+L3\cdot\cos(\alpha+\beta+\gamma) \quad (2)$$

Where, L1 is a distance in rotational pivot point between the boom 21 and the arm 22, L2 is a distance in rotational pivot point between the arm 22 and the bucket 23, and L3 is a distance between the rotational pivot point of the bucket 23 and the specific point P. α is an angle formed between the Y-axis (portion extending upward from the origin) and a straight line 11 that passes through the rotational pivot point of the boom 21 and the rotational pivot point of the arm 22 (portion extending from the origin toward the side of the rotational pivot point of the arm 22). β is an angle formed between the straight line 11 (portion extending from the rotational pivot point of the arm 22 toward the side opposite to the origin) and a straight line 12 that passes through the rotational pivot point of the arm 22 and the rotational pivot point of the bucket 23 (portion extending from the rotational pivot point of the arm 22 toward the side of the rotational pivot point of the bucket 23). γ is an angle formed between the straight line 12 (portion extending from the rotational pivot point of the bucket 23 toward the side opposite to the rotational pivot point of the arm 22) and a straight line 13 that passes through the specific point P.

The distance calculating part 133 translates the coordinate values (X, Y) of the specific point P defined in the X-Y coordinate system as described above to coordinate values (Xa, Ya) in the Xa-Ya coordinate system. The value of Ya of the specific point P obtained as described above is the value of the distance D between the specific point P and the target excavation surface S. The distance D represents a distance between an intersection point and the specific point P, in which the intersection point represents a point at which a straight line that passes through the specific point P and that is orthogonal to the target excavation surface S intersects the target excavation surface S. The value of Ya is then determined to be positive or negative (specifically, the distance D is positive in the excavation area and is negative in the range on the lower side of the target excavation surface S).

2-3 Bypass Valve Open/Close Control

Figure 9:
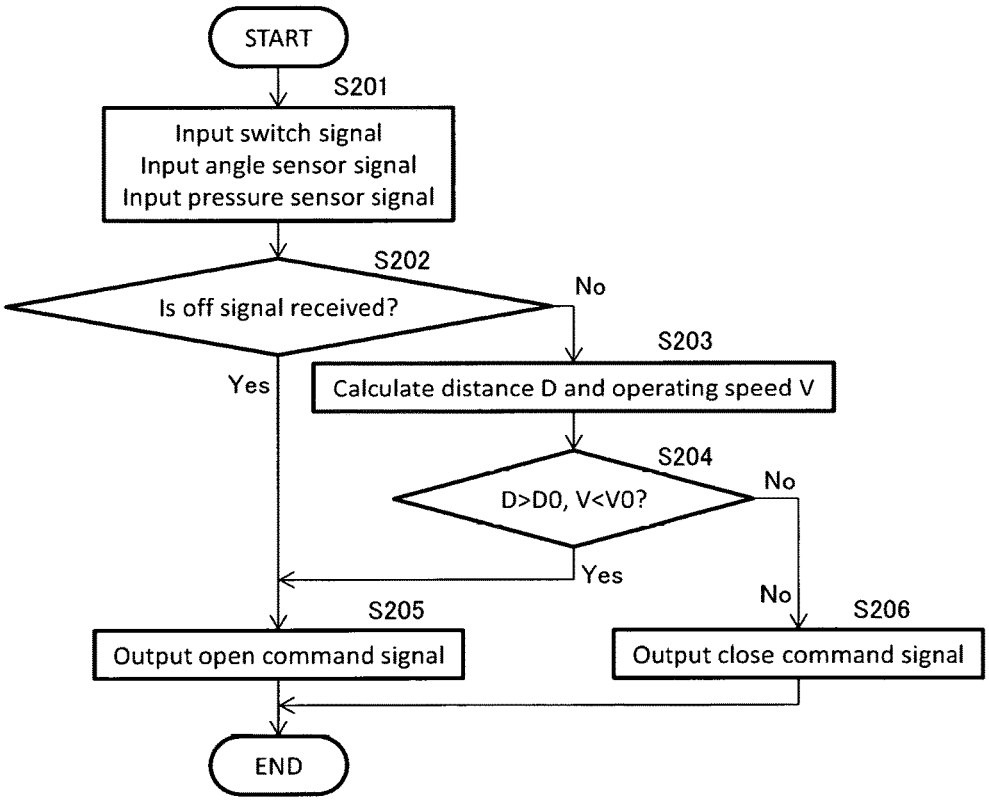
FIG. 9 is a flowchart of steps of bypass valve open/close control performed by the bypass valve control section shown in FIG. 7.

FIG. 9 is a flowchart of steps of bypass valve open/close control performed by the bypass valve control section. During operation, the bypass valve control section 130A repeatedly performs the steps shown in FIG. 9 at predetermined cycles (e.g., 0.1 seconds).

Step S201

The bypass valve control section 130A, having started the steps of FIG. 9, first receives inputs of signals from the switch 7, the angle sensors 8*a* to 8*c*, and the pressure sensors 6*a* and 6*b* via the input section 110 in Step S201. The steps in the example will be described on the assumption that the positional relation between the target excavation surface S and the machine is known. For a case in which the positional relation between the machine and the target excavation surface S is calculated, for example, in the earth coordinate system as described previously, the bypass valve control section 130A also receives inputs of signals from the positioning devices 9*a* and 9*b*, the radio 9*c*, and the inclination sensor 8*d*.

Steps S202→S205

The bypass valve control section 130A next determines whether the signal from the switch 7 is an off signal (Step S202). If it is determined that the signal is the off signal, the bypass valve control section 130A causes the open/close command part 137 to output an open command signal (Step S205) to thereby open the bypass valves 81*b*, 82*a*, 82*b*, 83*a*, and 83*b*. Steps performed in Steps S202 and S205 are similar to the steps performed in Steps S102 and S103 shown in FIG. 6.

Steps S202→S203→S204→S205

If it is determined that the signal of the switch 7 is an on signal, the bypass valve control section 130A performs Step S203, causing the distance calculating part 133 to calculate the distance D between the target excavation surface S and the specific point P and causing the speed calculating part 135 to calculate the operating speed V of the boom cylinder 31. In Step S204, the bypass valve control section 130A causes the distance determining part 134 to determine whether the distance D is greater than the set distance D0 read from the set distance storage part 141. The set distance D0 is a positive value and the distance D is determined to be positive or negative as described previously. Thus, the distance determining part 134 here determines whether the specific point P is within the excavation area and is spaced away from the target excavation surface S more than the set distance D0. At the same time, the bypass valve control section 130A causes the speed determining part 136 to determine whether the operating speed V is lower than the set speed V0 read from the set speed storage part 142. Because the set speed V0 is a positive value and the operating speed V is determined to be positive or negative as described previously, it is here determined whether the boom cylinder 31 contracts at a speed exceeding the set speed V0. If D>D0 and V<V0 (specifically, the abovementioned first to third conditions are satisfied in Steps S202 and S204), the bypass valve control section 130A performs Step S205 and causes the automatic open/close command part 138 to output an open command signal.

Steps S202→S203→S204→S206

If neither D>D0 nor V<V0 are satisfied after the performance of Steps S202, S203, and S204, the bypass valve control section 130A then performs Step S206. In Step S206, the bypass valve control section 130A causes the automatic open/close command part 138 to output a close command signal to thereby close the bypass valves 81*b*, 82*a*, 82*b*, 83*a*, and 83*b*. Step S206 corresponds to Step S104 of FIG. 6.

Because the electric circuit in the present embodiment is as shown in FIG. 3, the set distance D0 is set to a threshold with which control of the proportional solenoid valve 61*b*, for example, by the front control section 120 is determined to be performed. Specifically, when the distance D is equal to or smaller than the set distance D0, the shut-off valve 70 opens upon closure of the bypass valve 81*b*, for example, and the proportional solenoid valve 61*b*, for example, is energized by the front control section 120 according to, for example, the distance D (the opening degree is varied). In contrast, when the distance D exceeds the set distance D0, the shut-off valve 70 closes upon opening of the bypass valve 81*b*, for example, and the proportional solenoid valve 61*b*, for example, is also de-energized.

2-4 Effects

The present embodiment achieves effects similar to the effects achieved by the first embodiment because placing the front control function in the on state or the off state with the switch 7 opens or closes the bypass valves 81*b*, 82*a*, 82*b*, 83*a*, and 83*b*. In addition, when the specific point P is spaced away from the target excavation surface S more than the set distance D0 and the boom cylinder 31 does not contract at a speed exceeding the set speed V0, the bypass valves 81*b*, 82*a*, 82*b*, 83*a*, and 83*b* are opened even when the front control function is in the on state. Specifically, when the bucket 23 stays far away from the target excavation surface S and the bucket 23 may not immediately advance into a zone outside the excavation area even in consideration of the operating situation of the front work implement 20, priority is automatically given to responsiveness even when the front control function is in the on state. This can lead to further improvement in work efficiency.

Miscellaneous

Figure 10:
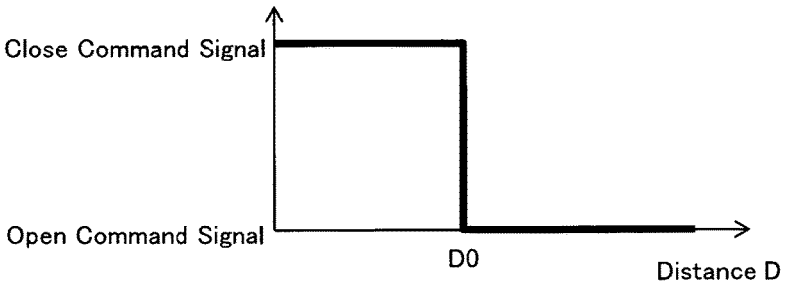
FIG. 10 is a diagram illustrating another example of bypass valve open/close control performed by the bypass valve control section included in the work machine according to the second embodiment of the present invention.

The second embodiment has been exemplified as a configuration in which the first to third conditions are satisfied in Step S204 when D>D0 and V<V0 and the bypass valve 81*b*, for example, opens even when the front control function is in the on state. The third condition governing the operating speed V may, however, be omitted. Specifically, as long as the distance D exceeds the set distance D0 (the first and second conditions are satisfied) even when the front control function is in the on state, the bypass valve 81*b*, for example, may be configured so as to open regardless of the operating speed V as depicted in FIG. 10. FIG. 10 depicts a relation between the command signals for the bypass valve 81*b*, for example, and the distance D. FIG. 10 illustrates an example in which the open command signal is output regardless of the operating speed V when the distance D exceeds the set distance D0 and the close command signal is output regardless of the operating speed V when the distance D is equal to or lower than the set distance D0. In this case, too, work efficiency can be improved in a situation in which the specific point P stays away from the target excavation surface S and the bucket 23 is less likely to move into a zone outside the excavation area, which advantageously simplify the control. Additionally, the set speed storage part 142, the speed calculating part 135, and the speed determining part 136 can be omitted.

The second embodiment has been described for a case in which the extension/contraction speed of the boom cylinder 31 is calculated as the operating speed V of the hydraulic actuator. The extension/contraction speed of the arm cylinder 32 or the bucket cylinder 33 may nonetheless be added as the operating speed V to determine whether to open or close the bypass valve 81*b*, for example. Understandably, a configuration is possible in which a plurality of elements may be selected from among the hydraulic actuators 31 to 33 and the operating speeds V thereof may be added. Additionally, a traveling speed of the specific point P may be calculated from the operating speeds V of one or a plurality of hydraulic actuators and a component perpendicular to the target excavation surface S may be extracted to thereby calculate a speed at which the specific point P approaches the target excavation surface S in the excavation area. Instead of simply considering the operating speed V of a hydraulic actuator, the operating speed V of the hydraulic actuator is translated to a speed at which the specific point D approaches the target excavation surface S and the approaching speed may serve as a basis for making a determination.

It is noted that the functional parts corresponding to the distance calculating part 133 and the speed calculating part 135 may be provided also for the front control section 120. A possible configuration in this case may be such that the distance D and the operating speed V calculated by the front control section 120 are applied to the distance determining part 134 and the speed determining part 136 of the bypass valve control section 130A.

A configuration has been described in which the bypass valves 81*b*, 82*a*, 82*b*, 83*a*, and 83*b* share a signal line with the shut-off valve 70 and energization current is passed through the signal line to thereby simultaneously control the bypass valve 81*b*, for example, and the shut-off valve 70. Signal lines may nonetheless be separately provided for the bypass valve 81*b*, for example, and the shut-off valve 70. When the signal lines are separately provided, the set distance D0 can be set to a value different from a distance (denoted D1) between the specific point P and the target excavation surface S, serving for determining whether the front control section 120 changes the opening degree of the proportional solenoid valve 61*b*, for example. It should, however, be noted that 0<D1≤D0 is a condition to be satisfied because the bypass valve 81*b*, for example, needs to be closed under a condition in which the maximum value of the pressure signal is limited using, for example, the proportional solenoid valve 61*b*. Alternatively, the bypass valves 81*b*, 82*a*, 82*b*, 83*a*, and 83*b* may be divided into a plurality of groups and a specific value of the set distance D0 may be set for each of the groups. In addition, the bypass valves 81*b*, 82*a*, 82*b*, 83*a*, and 83*b* are not necessarily all required and at least one may be selected from among these and mounted. In the example described above, a proportional solenoid valve or a bypass valve is not provided for the pilot lines 51*a*1 and 51*a*2 for a boom raising command. The proportional solenoid valve and the bypass valve may nonetheless be provided for the pilot lines 51*a*1 and 51*a*2 as necessary.

The bypass valves 81*b*, 82*a*, 82*b*, 83*a*, and 83*b* may be hydraulically driven open/close valves, and not solenoid valves. For example, the pump line 37*a* may be connected via the switch 7 to the hydraulic drive part of the bypass valves 81*b*, 82*a*, 82*b*, 83*a*, and 83*b* and the pump line 37*a* may be configured to be opened or closed by the switch 7. This configuration can establish a circuit including the bypass valve 81*b*, for example, as a hydraulically driven open/close valve.

The embodiment has been described for a case in which the proportional solenoid valves 61*b*, 62*a*, 62*b*, 63*a*, and 63*b* for pressure decrease and the bypass valves 81*b*, 82*a*, 82*b*, 83*a*, and 83*b* are each a normally open type and the proportional solenoid valves 71*a*, 73*a*, and 73*b* for pressure increase and the shut-off valve 70 are each a normally-closed type. Although the foregoing application of the normally-open type and the normally-closed type is preferable in the point that the energization current needs to be passed only when necessary, a circuit can be established by reversing timing of energization and de-energization even when the application of the normally-open type and the normally-closed type is reversed.

The embodiment has been described for a case in which the proportional solenoid valves 61*b*, 62*a*, 62*b*, 63*a*, and 63*b* for pressure decrease and the proportional solenoid valves 71*a*, 73*a*, and 73*b* for pressure increase are provided for the front control. Not all of the foregoing proportional solenoid valves are, however, necessarily required. One type of front control can be performed with at least one of the foregoing proportional valves (e.g., the proportional solenoid valve 61*b* that reduces pressure of the hydraulic signal for the boom lowering command). The present invention is applicable to any work machine that includes at least a proportional solenoid valve for reducing pressure of the hydraulic signals of the operation lever devices 51 to 54, because such a work machine includes a bypass valve provided so as to constitute a parallel circuit with respect to the proportional solenoid valve.

The embodiment has been described for a case in which the operating speed V of the hydraulic actuator is calculated on the basis of the magnitude of the pressure signal. The operating speed V of the hydraulic actuator may also be obtained on the basis of, for example, a rate of change in the signals of the angle sensors 8*a* to 8*c*. For example, the extension/contraction speed of the boom cylinder 31 can be obtained on the basis of a rate of change in the signal of the angle sensor 8*a*. A stroke sensor configured to detect a stroke amount of any of the hydraulic actuators 31 to 33 or an inclination angle sensor configured to detect an inclination angle of the boom 21, the arm 22, or the bucket 23 may be used to obtain the operating speed V of the hydraulic actuator.

While the embodiment of the present invention has been exemplified by a typical hydraulic excavator that uses an engine for the prime mover 17 to drive, for example, the hydraulic pump 36, the present invention can still be applied to a hybrid hydraulic excavator that uses an engine and an electric motor as the prime mover to drive, for example, the hydraulic pump 36. The present invention can also be applied to, for example, an electric hydraulic excavator configured to drive the hydraulic pump using an electric motor as a prime mover.

DESCRIPTION OF REFERENCE CHARACTERS

6*a*, 6*b*: Pressure sensor
7: Switch
8*a* to 8*c*: Angle sensor (posture sensor)
10: Machine body
20: Front work implement
31: Boom cylinder (hydraulic actuator)
32: Arm cylinder (hydraulic actuator)
33: Bucket cylinder (hydraulic actuator)
36: Hydraulic pump
37: Pilot pump
41-44: Control valve
51-54: Operation lever device
51*a*1, 51*a*2, 51*b*1, 52*a*1, 52*b*1, 53*a*1, 53*a*2, 53*b*1, 53*b*2, 54*a*1, 54*b*1: Pilot line
61*b*, 62*a*, 62*b*, 63*a*, 63*b*: Proportional solenoid valve
81*b*, 82*a*, 82*b*, 83*a*, 83*b*: Bypass valve
81B, 82A, 82B, 83A, 83B: Bypass line
110: Input section
120: Front control section
131: On/off determining part
133: Distance calculating part
134: Distance determining part
135: Speed calculating part
136: Speed determining part
137: Open/close command part
138: Automatic open/close command part
141: Set distance storage part
142: Set speed storage part
D: Distance between specific point and target excavation surface
D0: Set distance
170: Output section
P: Specific point
S: Target excavation surface
V: Operating speed of hydraulic actuator
V0: Set speed

The invention claimed is:

1. A work machine including
a machine body,
a front work implement disposed in the machine body,
a hydraulic actuator configured to drive the front work implement,
a posture sensor configured to detect posture of the front work implement,
a hydraulic pump,
a pilot pump,
a control valve configured to control a flow of hydraulic working fluid to be supplied from the hydraulic pump to the hydraulic actuator,
an operation lever device configured to generate a hydraulic signal directing operations of the hydraulic actuator in response to a control operation,
a pilot line configured to connect the operation lever device with a hydraulic drive part of the control valve,
a proportional solenoid valve disposed in the pilot line, and
a controller unit configured to calculate a limit command value for restricting operations of the front work implement through control of the proportional solenoid valve using a detection signal of the posture sensor,
the work machine comprising:
a bypass line configured to connect a portion in the pilot line upstream of the proportional solenoid valve and a portion in the pilot line downstream of the proportional solenoid valve, the pilot line having the proportional solenoid valve;
a bypass valve serving as an open/close valve disposed in the bypass line; and
a switch configured to output an on signal, that brings a control by the controller unit into an on state, or an off signal, that brings the control by the controller unit into an off state, to the controller unit,
wherein the controller unit is configured to perform steps of:
determining whether a signal input from the switch is the on signal or the off signal;
generating an open command signal to open the bypass valve when the signal input from the switch is the off signal and generating a close command signal to close the bypass valve when the signal input from the switch is the on signal; and
outputting to the bypass valve the open command signal or the close command signal.

2. The work machine according to claim 1,
wherein the controller unit stores a set distance established in advance with respect to a distance between a specific point in the front work implement and a target excavation surface,
the controller unit is further configured to perform steps of:
calculating the distance between the specific point and the target excavation surface using the detection signal of the posture sensor;

determining whether the distance between the specific point and the target excavation surface is greater than the set distance; and generating the open command signal regardless of whether the signal from the switch is the on signal or the off signal when the distance between the specific point and the target excavation surface is greater than the set distance.

3. The work machine according to claim 1, wherein the controller unit stores a set distance established in advance with respect to a distance between a specific point in the front work implement and a target excavation surface, and a set speed established in advance with respect to an operating speed of the hydraulic actuator, the controller unit is further configured to perform steps of:

calculating the distance between the specific point and the target excavation surface using the detection signal of the posture sensor;

determining whether the distance between the specific point and the target excavation surface is greater than the set distance;

calculating the operating speed of the hydraulic actuator using pressure of the hydraulic signal of the operation lever device or the detection signal of the posture sensor;

determining whether the operating speed of the hydraulic actuator is greater than the set speed; and generating the open command signal when the distance between the specific point and the target excavation surface is greater than the set distance and the operating speed of the hydraulic actuator is smaller than the set speed.

4. The work machine according to claim 1, wherein the switch is disposed in the operation lever device.

* * * * *